United States Patent [19]

Saad et al.

[11] Patent Number: 4,553,112

[45] Date of Patent: Nov. 12, 1985

[54] OVERMODED TAPERED WAVEGUIDE TRANSITION HAVING PHASE SHIFTED HIGHER ORDER MODE CANCELLATION

[75] Inventors: Saad S. Saad, Chicago; Charles M. Knop, Lockport, both of Ill.

[73] Assignee: Andrew Corporation, Orland Park, Ill.

[21] Appl. No.: 499,318

[22] Filed: May 31, 1983

[51] Int. Cl.[4] ..... H01P 1/162

[52] U.S. Cl. ..... 333/21 R; 333/34; 333/157; 333/251

[58] Field of Search ..... 333/21 R, 21 A, 251, 333/254, 248, 34, 157; 343/786, 781 CA

[56] References Cited

U.S. PATENT DOCUMENTS

| | | | |
|---|---|---|---|
| 3,050,701 | 8/1962 | Tang . | |
| 3,421,086 | 1/1969 | Medford | 333/21 R X |
| 3,569,871 | 3/1971 | Tomigasu | 333/254 X |
| 3,662,393 | 5/1972 | Cohn | 343/786 |
| 3,896,449 | 7/1975 | Blume | 333/21 R X |

FOREIGN PATENT DOCUMENTS

| | | | |
|---|---|---|---|
| 1063662 | 8/1959 | Fed. Rep. of Germany | 333/34 |
| 1069231 | 11/1959 | Fed. Rep. of Germany | 333/21 |
| 1142543 | 9/1957 | France | 333/231 |

OTHER PUBLICATIONS

Sporleder and Unger "Waveguide Tapers, Transition and Couplers", *Gradual Waveguide Transitions,* (1979) pp. 220–228.

Young, L. ed., "Advances in Microwaves", *Mode Conversion in Waveguides and Transitions,* pp. 328–335.

Tang, C. C. H., "Optimization of Waveguide Tapers Capable of Multimode Propagation", IRE Transactions on Microwave Theory and Technique, (Sep. 1961) pp. 442–452.

*Primary Examiner*—Eugene R. LaRoche
*Assistant Examiner*—Benny T. Lee
*Attorney, Agent, or Firm*—Leydig, Voit & Mayer, Ltd.

[57] ABSTRACT

A phased-overmoded, tapered waveguide transition has a central section which is tapered linearly in the longitudinal direction and two end sections which are tapered curvilinearly in the longitudinal direction. One of the end sections and at least a portion of the other end section are overmoded and, therefore, give rise to higher order modes of the desired microwave signals propagated therethrough. The lineraly tapered central section shifts the phase of higher order modes generated at one end of the transition so that at least a major portion of such higher order modes is cancelled by higher order modes generated at the other end of the transition.

18 Claims, 5 Drawing Figures

OVERMODED TAPERED WAVEGUIDE TRANSITION HAVING PHASE SHIFTED HIGHER ORDER MODE CANCELLATION

TECHNICAL FIELD

The present invention relates generally to waveguides for microwave systems and, more particularly, to waveguide transitions or tapers for coupling two or more waveguides having different cross-sections (the cross-sections may differ in shape and/or size).

BACKGROUND ART

Although overmoded waveguides are generally recognized as undesirable in microwave systems, their employment has become necessary because of the need to minimize the losses and/or to accommodate multi-frequency operation in many modern microwave systems. This need for overmoded waveguides presents a problem, however, because the resulting higher-order modes generated in an overmoded waveguide make it more difficult to achieve another increasingly significant objective of modern microwave systems, namely, narrower radiation patterns required by today's crowded microwave spectrum.

In addition to the problem mentioned above, the higher-order modes generated by overmoded waveguide give rise to a group delay problem. That is, certain of the higher-order modes are re-converted to the desired mode, but only after they have traveled through the overmoded waveguide at different velocities, thereby producing desired mode signals which are not in phase with each other. This problem becomes more serious as the length of the overmoded waveguide is increased.

DISCLOSURE OF THE INVENTION

It is a primary object of the present invention to provide an overmoded waveguide transition which, for any given application, reduces the length of the transition and/or the level of undesired higher-order modes produced by the transition. A related object of the invention is to provide such an improved transition which also has a low return loss, i.e., reflection of the desired mode.

It is another important object of this invention to provide such an improved overmoded waveguide transition which is capable of reducing the levels of undesired higher-order modes substantially below those of conventional transitions of the same length.

A further object of this invention is to provide an improved overmoded waveguide transition which is capable of producing such improved results over a relatively wide frequency band, e.g., 6 to 11 GHz.

Yet another object of this invention is to provide such an improved overmoded waveguide transition which permits the attainment of improved radiation patterns when used in antenna feed systems.

A still further object of the invention is to provide such an improved waveguide transition which improves the performance of both "open" and "closed" waveguide feed systems.

Other objects and advantages of the invention will be apparent from the following detailed description and the accompanying drawings.

In accordance with the present invention, the foregoing objects are realized by an overmoded, tapered waveguide transition having a central section which is tapered linearly in the longitudinal direction and two end sections which are tapered curvilinearly in the longitudinal direction, at least a portion of said curvilinearly tapered sections being overmoded and, therefore, giving rise to higher order modes of the desired microwave signals propagated therethrough, the linearly tapered central section shifting the phase of higher order modes generated at one end of the transition so that at least a major portion of such higher order modes are cancelled by higher order modes generated at the other end of the transition.

While the invention will be described in connection with certain preferred embodiments, it will be understood that it is not intended to limit the invention to those particular embodiments. On the contrary, it is intended to cover all alternatives, modifications and equivalent arrangements as may be included within the spirit and scope of the invention as defined by the appended claims.

BEST MODE FOR CARRYING OUT THE INVENTION

Figure 1:
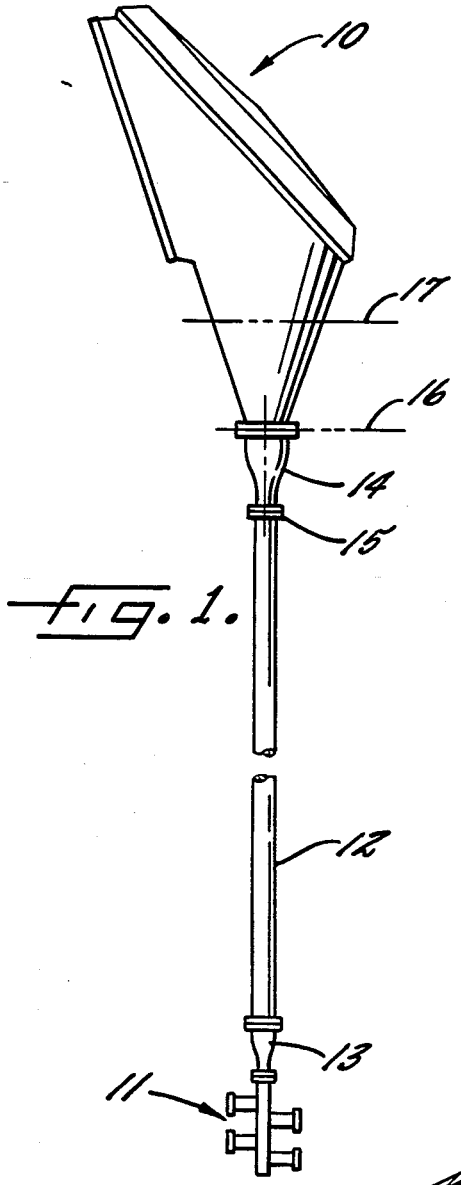
FIG. 1 is a side elevation of a horn-reflector microwave antenna and an associated feed system embodying the present invention.

Turning now to the drawings and referring first to FIG. 1, there is shown a horn-reflector antenna 10 mounted on top of a tower (not shown) and fed by a multi-port combiner 11 located near the bottom of the tower. The antenna 10 and the combiner 11 are connected by a long waveguide 12 of relatively large diameter so as to minimize the attenuation losses therein and/or to permit simultaneous operation with dual polarized signals in multiple frequency bands. Because of the relatively large diameter of the waveguide 12, it is over-moded, i.e., it will support the propagation of unwanted higher order modes of the desired microwave signals being propagated therethrough. This type of antenna feed system is sometimes referred to as an "open" system, i.e., the waveguide becomes progressively larger, proceeding from the flange 15, through the transition 14, toward the antenna 10.

The purpose of the combiner 11 is to permit the transmission and reception of two or more (four in the example of FIG. 1) signals having different frequencies and/or different polarizations via a single antenna 10 having a single waveguide 12 running up the tower. For example, the combiner 11 can accommodate one pair of orthogonally polarized signals in the 6-GHz frequency band, and another pair of orthogonally polarized signals in the 11-GHz frequency band. Examples of combiners suitable for this purpose are described in Saad copending application Ser. No. 461,930 filed Jan. 28, 1983, for "Multi-Port, Multi-Frequency Microwave Combiner with Overmoded Square Waveguide Section", now U.S. Pat. No. 4,491,810, and in Ekelman et al. copending application Ser. No. 384,997, filed June 4, 1982, for "Multi-Port Combiner for Multi-Frequency Microwave Signals", now U.S. Pat. No. 4,504,805, both of which are assigned to the assignee of the present invention.

Figure 2:
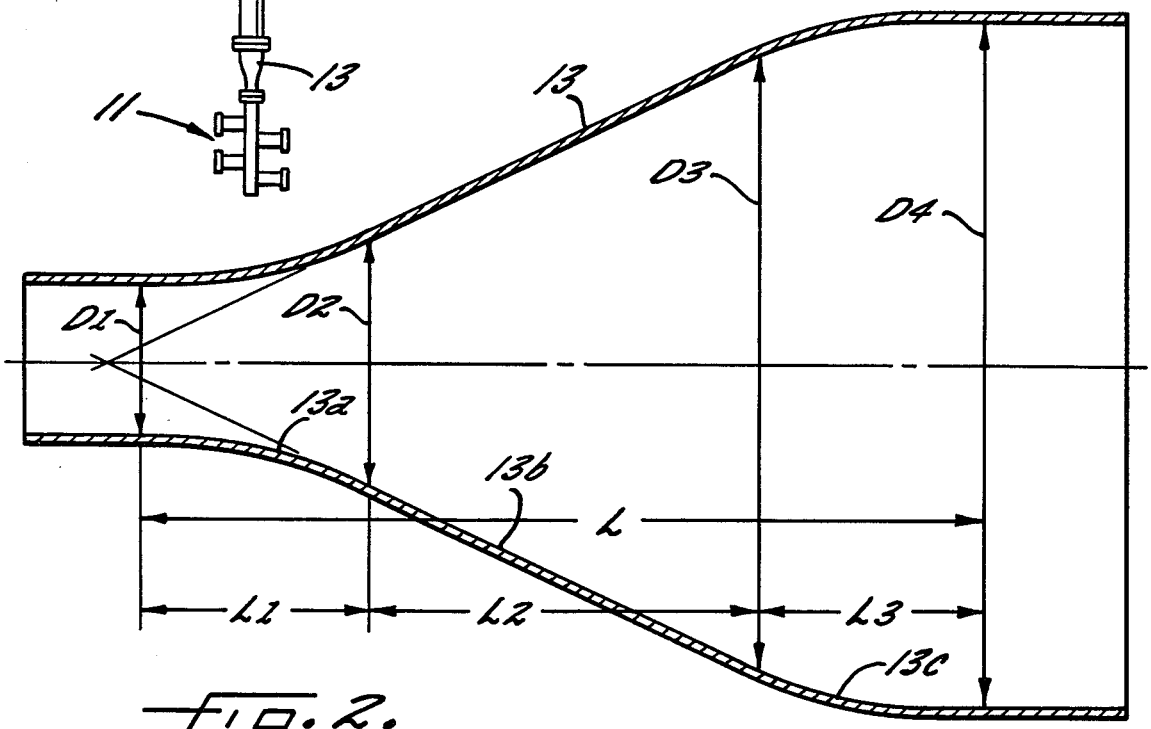
FIG. 2 is an enlarged longitudinal section of one of the waveguide transitions in the antenna feed system shown in FIG. 1.

At the lower end of the waveguide run 12, the waveguide is coupled to the combiner 11 by a transition 13 which is shown in more detail in FIG. 2. The inside walls of the transition 13 taper monotonically from the relatively small cross-section at the mouth of the combiner 11 (D1) to the relatively large cross-section of the overmoded waveguide 12 (D4). A similar (though layer in diameter) transition 14 at the upper end of the waveguide 12 couples the waveguide to the lower end of the horn portion of the horn-reflector antenna 10.

Referring to FIG. 2, it can be seen that the transition comprises three different sections 13*a*, 13*b* and 13*c*. The two end sections 13*a* and 13*c* are tapered sections of variable slope which terminate at opposite ends of the transition with respective cross-sections D1 and D4 identical to those of the two different waveguide cross-sections at the mouth of the combiner 11 and the waveguide 12. These end sections 13*a* and 13*c* are non-uniform because the radii thereof change at variable rates along the axis of the transition, i.e., the inside surfaces of these sections 13*a* and 13*c* are tapered curvilinearly in the longitudinal direction. The two curvilinear sections 13*a* and 13*c* preferably have zero slope at the diameters D1 and D4 where they mate with the respective waveguides to be connected. One of these end sections is overmoded throughout, and at least a portion of the other end section is also overmoded.

The center or intermediate section 31*b* is an overmoded tapered section of constant slope, i.e., its radius changes at a constant rate along the axis of the transition, producing a linearly tapered inside surface between diameters D2 and D3. The two end sections 13*a* and 13*c* merge with opposite ends of the tapered section of constant slope 13*b* without any discontinuity in the slope of the internal walls of the transition; that is, each of the end sections 13*a* and 13*c* has the same slope as the center section 13*b* where the respective end sections join with the center section, i.e., at D2 and D3.

Because the central section 13*b* of the transition 13 is tapered linearly in the longitudinal direction, this section of the transition results in virtually no unwanted higher order modes such as the $TM_{11}$ mode. More importantly, the linearly tapered central section 13*b* functions as a phase shifter between the two curvilinear end sections 13*a* and 13*c*. This phase-shifting function of the central section 13*b* is significant because it is a principal factor in the cancellation, within the transition 13, of higher order modes generated within the curvilinear end sections 13*a* and 13*c*.

It has been found that by proper dimensioning and shaping of the three sections of the transition 13, the generation of unwanted higher order modes by the transition can be virtually eliminated, while at the same time minimizing the length of the transition. Moreover, the return loss of the transition can be kept well within acceptable limits.

More specifically, the parameters of the waveguide transition 13 that can be varied to achieve the desired results are the diameters D2 and D3 at opposite ends of the linearly tapered central section 13*b*, the lengths L1, L2 and L3 of the three transition sections 13*a*, 13*b* and 13*c*, and the shape of the longitudinal curvature of the two curvilinear end sections 13*a* and 13*c*. By judiciously varying these parameters and testing various combinations thereof, either empirically or by numerical simulation, an optimum waveguide transition can be designed for virtually any desired application. The diameters D1 and D4 of the ends of the transition are, of course, dictated by the sizes of the waveguides to which the transition 13 is to be connected. Thus, in the particular example illustrated in FIG. 1, the diameter D1 at the small end of the transition 13 is the same as the diameter of the mouth of the combiner 11, and the diameter D4 at the large end of the transition 13 is the same as the diameter of the waveguide 12.

The preferred shape of the longitudinal curvature of the two curvilinear end sections 13*a* and 13*c* is usually hyperbolic or a variation thereof, although parabolic or sinusoidal shapes are also suitable for certain applications. A relatively short overall transition length $L=L1+L2+L3$ can be arbitrarily selected, e.g., $L=3\times D4$. For a given L and longitudinal curvature of the two end sections, the diameter D2 and the lengths L1, L2 and L3 can be varied to minimize the higher order mode levels generated by the transition. In general, the higher order mode levels, as well as the return loss, will decrease as the total length L is increased. But, one of the significant advantages of the present invention is that relatively low levels of the higher order modes can be achieved with a relatively short total transition length L.

Although waveguide transitions with linearly tapered central sections and curvilinearly tapered end sections have been used or proposed heretofore, it has never been recognized that the parameters of such a transition could be adjusted to cause higher order modes generated at opposite ends of the transition to cancel each other. For example, Sporleder and Unger, *Waveguide Tapers, Transitions & Couplers*, Section 6.6, describes a transition with a linearly tapered center section and curvilinearly tapered end sections; that treatise states that opposite ends of the transition should be designed independently of each other, the narrow end being single-moded with minimum VSWR as the design criterion, and the large end being overmoded and designed to minimize the generation of higher-order modes.

In the transition of the present invention, both end sections 13*a* and 13*c* of the transition are overmoded so that they both give rise to higher order modes, and the intermediate section 13*b* serves as a phase shifter which, when properly designed, causes at least a major portion of the higher order modes generated at one end of the transition to be cancelled by those generated at the other end of the transition. The net result is that the overall transition produces higher order mode levels substantially below those of conventional transitions (e.g., binomial or $\sin^2$) of the same length. In the preferred embodiments, the higher order mode levels are at least 5 dB below those of a $\sin^2$ transition of the same length for a prescribed single frequency range; in a circular waveguide transition, for example, the level of the $TM_{11}$ mode is reduced at least 5 dB further below the dominant mode $TE_{11}$ than in a $\sin^2$ transition of the same length. For multiple frequency bands, the higher order mode levels are reduced at least 2 dB below those of a $\sin^2$ transition of the same length.

Figure 3:
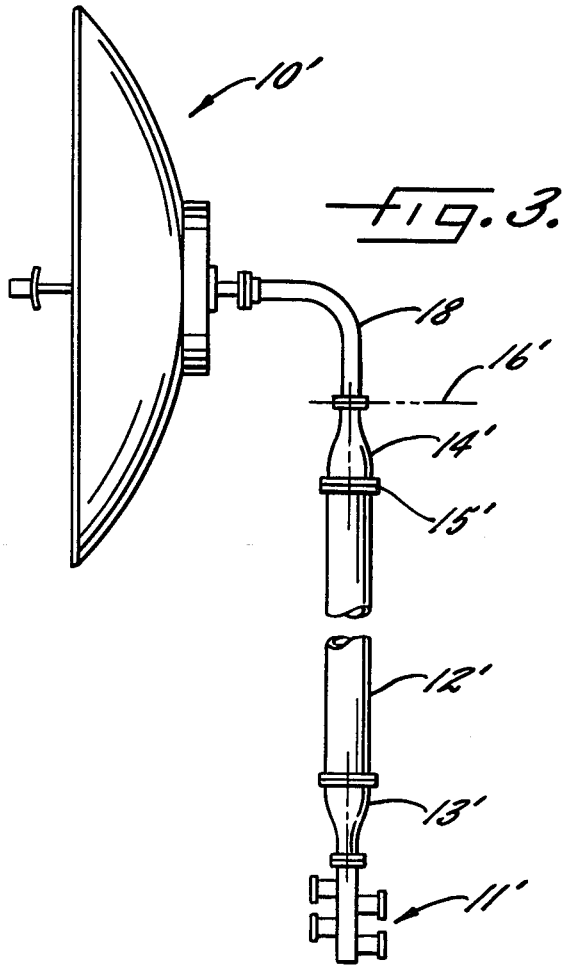
FIG. 3 is a side elevation of a reflector microwave antenna and an associated feed system embodying the invention.

Although it is generally preferred to use an "open" waveguide feed system of the type illustrated in FIG. 1 because such a system usually minimizes losses, there are situations where it is desirable to use a "closed" feed system of the type illustrated in FIG. 3. For example, it may be desired to prevent higher order modes contained in the signals received by the antenna from entering the waveguide run 12'. Such higher order modes can be produced, for example, by mis-alignment of the receiving antenna. Also, imperfections in long waveguide runs can produce unwanted higher order modes in both the receive and transmit modes, and the "closed" system can be used to trap and damp out these higher order modes.

Even when a "closed" system is desirable because of the presence of higher order modes originating from a source other than the waveguide transitions, it is advantageous to use the transitions of this invention in order to minimize the higher order mode levels within the trap, thereby minimizing losses within the feed system. Thus, in the "closed" feed system shown in FIG. 3, the combiner 11' is coupled to the waveguide 12' by a transition 13' similar to the transition 13 of FIGS. 1 and 2. The diameter of the upper end of the transition 13' matches that of a circular waveguide 12' extending up the tower (not shown) and coupled at its upper end to a reflector-type antenna 10' via a transition 14' and a pipe 18 which allows propagation of only the desired mode. Unlike the upper transition 14 in the system of FIG. 1, the upper transition 14' in the system of FIG. 3 has its large end connected to the waveguide 12' and its small end connected to the antenna 10' via pipe 18. It can be seen that the combination of the waveguide 12' and the two transitions 13' and 14' form a trap for any higher order modes that enter the system, with some sacrifice in the loss of the system. By virtually eliminating the higher order modes contributed by the transitions 13' and 14', however, the sacrifice in loss is minimized.

By significantly reducing the higher order mode levels, the tapered transitions of this invention bring the echo levels down in both the open system (FIG. 1) and the closed system (FIG. 3). In the open system, this applies to both the "one way echo" caused by mode generation at the bottom taper 13 of FIG. 1 followed by travel up the waveguide 12 and reconversion to the desired mode at the taper 14 and the lower portion of the antenna (between planes 16 and 17), and the "two way echo" caused by mode generation at the top (in the taper 14 and the lower portion of the antenna 10, between planes 16 and 17) and its round-trip, down and then up, through the waveguide 12 and reconversion to the desired mode in the taper 14 and the antenna 10 (between planes 16 and 17). In the closed system, the improved transitions significantly reduce the level of trapped modes therein which, in turn reduces the echo produced by their reconversion into the desired mode. This reduction is, in fact, so significant that absorption type mode filters normally used in waveguide 12' of FIG. 3 are no longer necessary.

A $\sin^2$ tapered transition provides a definite standard for comparison with the transitions of the present invention because the length of a $\sin^2$ transition uniquely specifies its shape. Thus, in a circular waveguide transition of length L between radii r1 and r2, the radius r(z) of a $\sin^2$ transition varies according to the following equation:

$$r(z)=r1+(r2-r1)\sin^2(\pi z/2L).$$

By contrast, a binomial transition requires selection of an arbitrary integration limit A for any given design frequency f (usually chosen as the lowest frequency in the desired band) and transition length L.

The following table contains the theoretically predicted $TM_{11}$ mode levels of three different types of transitions, each 9.5" long, for coupling a WC166 circular waveguide (i.e., D1=1.66") to a WC281 circular waveguide (i.e., D4=2.812"):

| | $TM_{11}$ Mode Level (dB) | | |
|---|---|---|---|
| Freq. Band (GHz) | Invention | $\sin^2$ | Binomial |
| 7.725–8.275 | −28 | −22 | −20 |
| 10.7–11.7 | −31 | −23 | −16 |
| 5.9–11.7 | −24 | −22 | −15 |

The performance of each of the three transitions is presented for three different frequency bands. The binomial transitions were designed with an integration limit A of 3; the $\sin^2$ transition was designed according to the r(z) equation given above; and the transitions of the present invention were designed with the following dimenions for the different frequency bands:

| | 8 GHz | 11 GHz | 6–11 GHz |
|---|---|---|---|
| L1 (in.) | 3.467 | 1.171 | 1.931 |
| L2 (in.) | 0.313 | 4.000 | 2.354 |
| D2 (in.) | 2.130 | 1.765 | 1.865 |
| D3 (in.) | 2.205 | 2.460 | 2.337 |

It can be seen from the above data that the multi-band (5.9–11.7 GHz) transition of the present invention provides a $TM_{11}$ level is 9 dB below that of the binomial transition and 2 dB below that of the $\sin^2$ transition. In the single-band cases, the superiority of the transitions of the invention is even greater: 6 to 8 dB better than the $\sin^2$ transitions, and 8 to 15 dB better than the binomial transitions.

Figure 4:
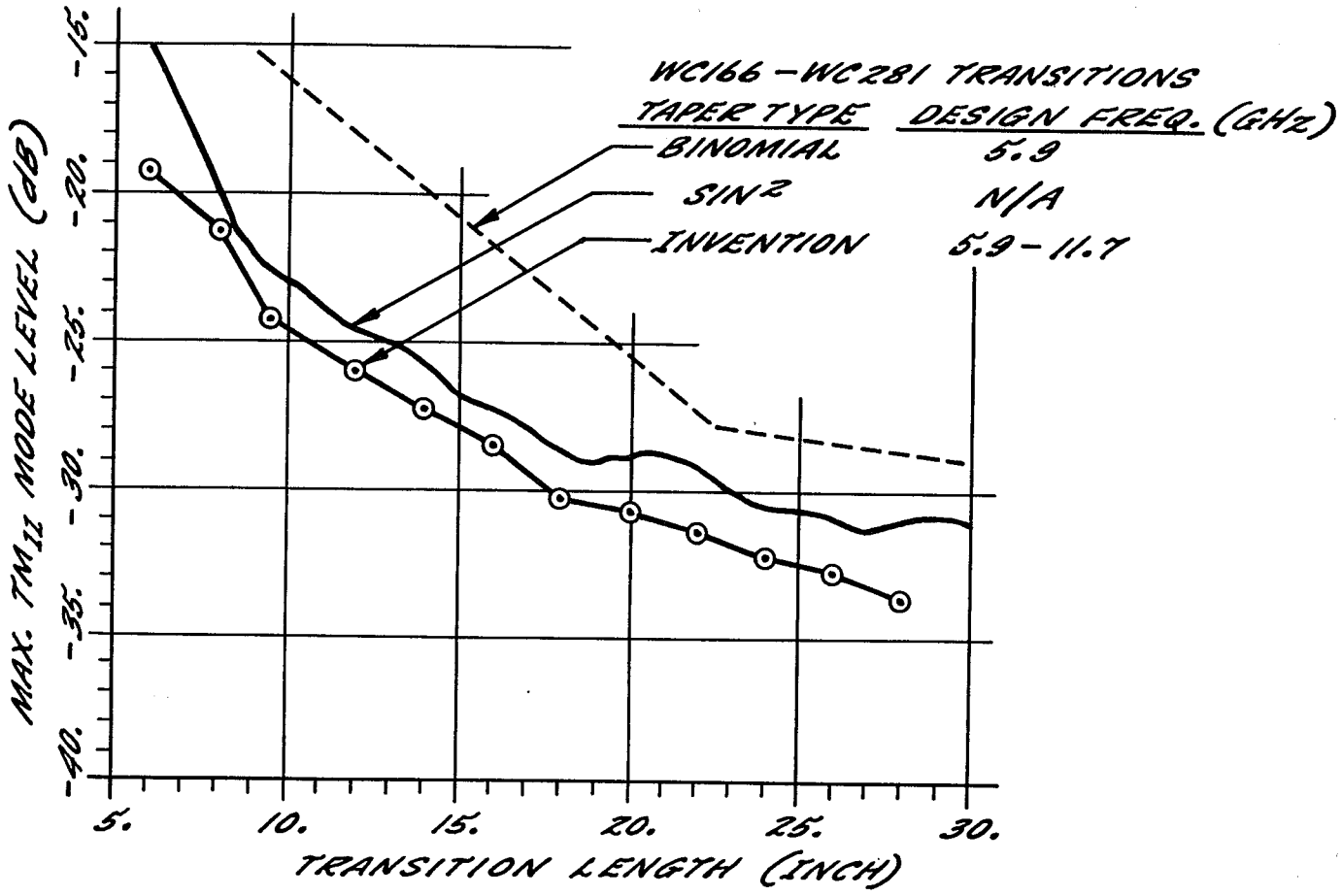
FIG. 4 is a graph illustrating the level of the $TM_{11}$ circular waveguide mode as a function of the transition length for three different types of waveguide transitions, for a frequency band of 5.9 to 11.7 GHz.
Figure 5:
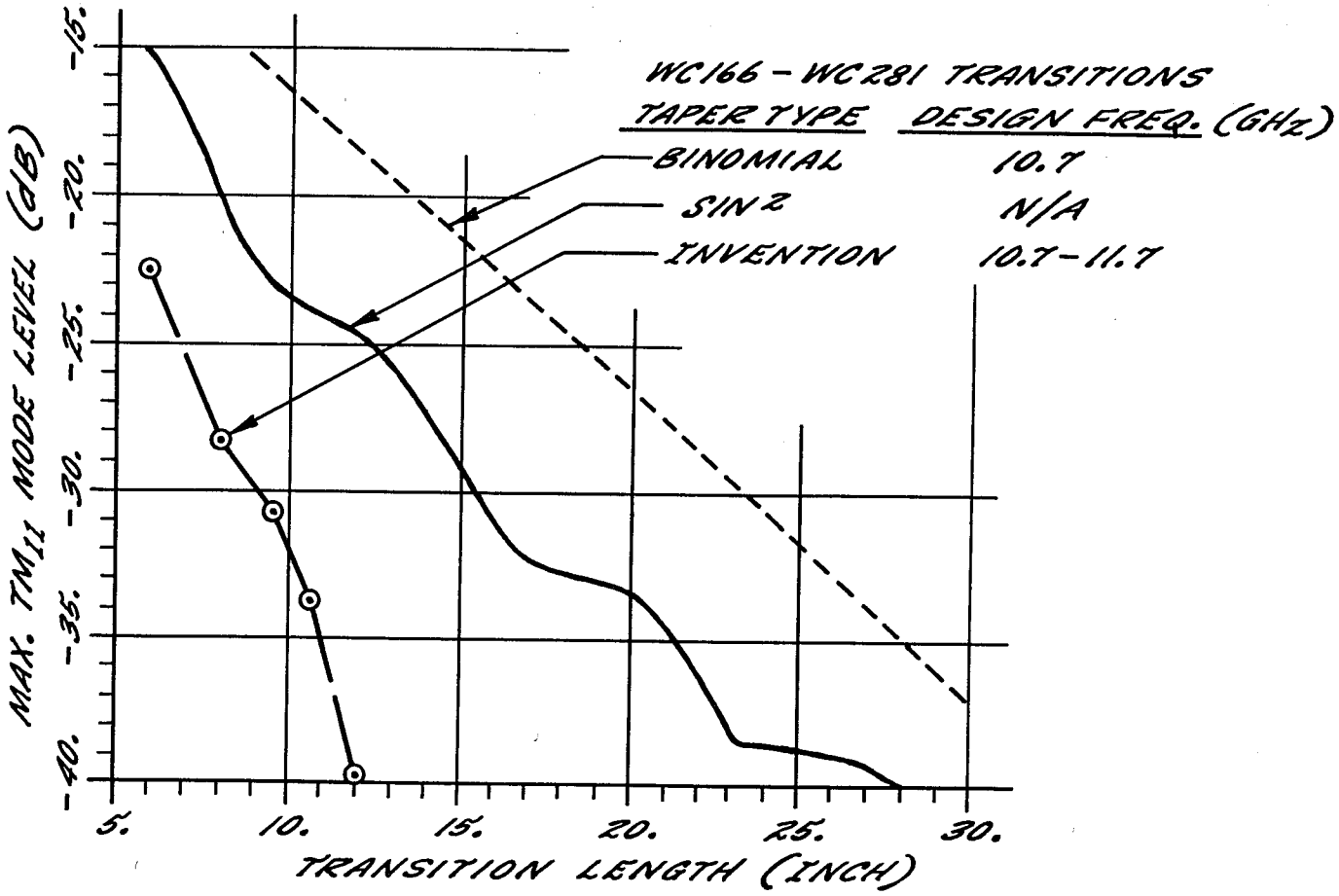
FIG. 5 is a graph illustrating the $TM_{11}$ mode level as a function of the transition length for the same three types of waveguide transitions, redesigned for a frequency band of 10.7 to 11.7 GHz.

The superiority of the transition of this invention is further illustrated by the graphs of FIGS. 4 and 5. These graphs plot the maximum $TM_{11}$ mode level as a function of transition length for specified frequency bands. Three graphs are presented in each figure, representing the same three types of transitions described above. It can be seen from these graphs that the transitions of the present invention produce significantly lower $TM_{11}$ mode levels than the binomial or $\sin^2$ transitions. Or, for a particular $TM_{11}$ mode level, the transitions of the invention are significantly shorter and, therefore, less expensive.

Although the invention has been described with particular reference to transitions for joining waveguides of similar cross-sectional geometry, e.g., circular-to-circular, it is equally applicable to transitions between waveguides of different cross-sectional geometry, e.g., rectangular-to-circular. It will also be appreciated that the transitions of this invention need not be overmoded over the entire operating frequency band. Furthermore, the invention is not limited to transitions between two straight waveguide sections, but also can be used between a straight waveguide section and a horn.

As can be seen from the foregoing detailed description, this invenion provides an overmoded waveguide transition which, for any given application, reduces the length of the transition and/or the level of undesired higher-order modes produced by the transition. These transitions also have a low return loss. By providing a phase-shifting linear section in the middle of the transition, coupled with overmoded curvilinear end sections, the transitions of this invention reduces the level of undesired higher-order modes substantially below those of conventional transitions of the same length, and is capable of producing such improved results over a relatively wide frequency band. As a result of these reduced higher-order mode levels, the transitions of this invention permit the attainment of improved radiation patterns when used in antenna feed systems, and can be used to improve the performance of both "open" and "closed" feed systems.

We claim as our invention:

1. A phased-overmoded, tapered waveguide transition for coupling two waveguides for the propagation of desired microwave signals therethrough, said waveguides being displaced along a longitudinal direction and having different transverse dimensional cross-sections, the inside walls of said transition tapering from one of said waveguide cross-sections to the other, said transition comprising a central section which is tapered with a constant slope along its longitudinal section and two end sections which are tapered with a variable slope resulting in a curvature along the longitudinal section, each of said end sections having the same slope as said central section where the respective end sections join with said central section, one of said end sections and at least a portion of the other of said end sections being over-moded and, therefore, giving rise to higher order modes of the desired microwave signals propagated therethrough, said linearly tapered central section shifting the phase of higher order modes generated along one end section of the transition so that at least the major portion of such higher order modes is cancelled by higher order modes generated along the other end section of the transition.

2. A phased overmoded, tapered waveguide transition as set forth in claim 1 which is tapered monotonically in the longitudinal direction from one of said end sections to the other of said end sections.

3. A phase-overmoded, tapered waveguide transition as set forth in claim 1 wherein the curvature along the longitudinal section of each of said end sections is hyperbolic.

4. A phased-overmoded, tapered waveguide transition as set forth in claim 1 which has a circular cross-section and a higher order mode level substantially below that of a $\sin^2$ transition of the same length said $\sin^2$ transition having a radius r(Z) that varies along a length L according to the equation $$r(Z)=r1+(r2-r1)\sin^2(\pi Z/2L)$$

where r1 and r2 are the radii at opposite ends of the transition, and Z is the axial distance from the end of the transition where said radius r1 is measured.

5. A phased-overmoded, tapered waveguide transition as set forth in claim 4 which for a given length of the transition, has a higher order mode level at least 5 dB below that of a $\sin^2$ transition of the same given length within a prescribed single frequency band.

6. A phased-overmoded, tapered waveguide transition as set forth in claim 1 and having a circular transverse cross-section along the entire length of the transition.

7. A phase-overmoded, tapered waveguide transition for coupling two waveguides having different transverse dimensional cross-sections, the inside walls of said transition tapering monotonically from one of said waveguide cross-sections to the other, said transition comprising a section of constant slope disposed between and merging with two tapered sections of variable slope with a curvature along the longitudinal section, each of said tapered sections of variable slope terminating with a transverse cross-section identical to the corresponding one of said two different waveguide cross-sections, each of said sections of variable slope having the same slope as said section of constant slope where the respective variable-slope sections joined with said constant-slope section, one of said tapered transition sections of variable slope and at least a portion of the other of said tapered transition sections of variable slope being over-moded so that modes of a higher order than the desired mode are generated therein, said tapered section of constant slope shifting the phase of the higher order modes generated in said tapered sections of variable slope so that at least a major portion of the higher order modes generated along one tapered transition section of variable slope is cancelled by the higher order modes generated along the other tapered section of variable slope.

8. A phase-overmoded, tapered waveguide transition as set forth in claim 7 which has a circular cross-section and produces higher order mode levels substantially below those of a $\sin^2$ transition of the same length, said $\sin^2$ transition having a radius r(Z) that varies along a length L according to the equation $$r(Z)=r1+(r2-r1)\sin^2(\pi Z/2L)$$

where r1 and r2 are the radii at opposite ends of the transition, and Z is the axial distance from the end of the transition where said radius r1 is measured.

9. A phased-overmoded, tapered waveguide transition as set forth in claim 8 which, for a given length of the transition, produces higher order mode levels at least 5 dB below those of a $\sin^2$ transition of the same given length within a prescribed single frequency band.

10. A phased-overmoded, tapered waveguide transition as set forth in claim 7 and having a circular transverse cross-section along the entire length of the transition.

11. A phased-overmoded, tapered waveguide transition as set forth in claim 7 wherein the curvature along the longitudinal section of each of the tapered sections of variable slope is hyperbolic.

12. A phased-overmoded, tapered waveguide transition for coupling two waveguides for the propagation of desired microwave signals therethrough, said waveguides being displaced along a longitudinal direction and having different transverse dimensional cross-sections, the transverse cross-section of said transition tapering longitudinally from one of said waveguide cross-sections to the other, said transition comprising a tapered section of constant slope forming a central section of the transition and a pair of tapered sections of variable slope with a curvature along the longitudinal section merging with opposite ends of said tapered section of constant slope to form the end sections of the transition, each of said sections of variable slope having the same slope as said section of constant slope where the respective variable-slope sections join with said constant-slope section, one of said tapered sections of variable slope, and at least a portion of the other of said tapered sections of variable slope giving rise to undesired higher-order modes of the desired microwave signals propagated therethrough, said tapered sections of constant slope shifting the phase of said higher-order modes so that such higher order modes are at least partially cancelled within the transition.

13. A phased-overmoded, tapered waveguide transition as set forth in claim 12 which is tapered monotonically in the longitudinal direction from one of said end sections to the other of said end sections.

14. A phased-overmoded, tapered waveguide transition as set forth in claim 12 wherein the curvature along the longitudinal section of each of said tapered sections of variable slope is hyperbolic.

15. A phased-overmoded, tapered waveguide transition as set forth in claim 12 which has a circular cross-section and produces, for a given length of the transition, higher order mode levels substantially below that of a $\sin^2$ transition of the same given length said $\sin^2$ transition having a radius r(Z) that varies along a length L according to the equation $$r(Z)=r1+(r2-r1)\sin^2(\pi Z/2L$$

where r1 and r2 are the radii at opposite ends of the transition, and Z is the axial distance from the end of the transition where said radius r1 is measured.

16. A phased-overmoded, tapered waveguide transition as set forth in claim 15 which, for any given length of the transition, has a higher order mode level at least 5 db below that of a $\mathrm{Sin}^2$ transition of the same given length within a prescribed single frequency band.

17. A phased-overmoded, tapered waveguide transition as set forth in claim 12 and having a circular transverse cross-section along the entire length of the transition.

18. A phased-overmoded, waveguide taper for coupling two waveguides for the propagation of desired microwave signals therethrough, said waveguides being displaced along a longitudinal direction, said taper having different transverse dimensional cross-sections at opposite ends thereof, and comprising a central section which is tapered with a constant slope along its longitudinal section and two end sections which are tapered with a variable slope resulting in a curvature along the longitudinal section, each of said end sections having the same slope as said central section where the respective end sections join with said central section, one of said end sections and at least a portion of the other of said end sections being over-moded and, therefore, giving rise to higher order modes of the desired microwave signals propagated therethrough, said linearly tapered central section shifting the phase of higher order modes generated at one end of the taper so that at least the major portion of such higher order modes is cancelled by higher order modes generated at the other end of the taper.

* * * * *